US005480293A

United States Patent [19]

Dinca et al.

[11] Patent Number: 5,480,293

[45] Date of Patent: Jan. 2, 1996

[54] ROTARY DISTRIBUTOR FUEL INJECTION APPARATUS

[75] Inventors: Milan Dinca; Gheorghe V. Moisescu, both of Bucharest, Romania

[73] Assignee: Master S.A., Bucharest, Romania

[21] Appl. No.: 143,569

[22] Filed: Oct. 26, 1993

[51] Int. Cl.[6] ..... F04B 19/02

[52] U.S. Cl. ..... 417/462; 123/450

[58] Field of Search ..... 417/467, 488; 123/449, 450, 503, 506

[56] References Cited

U.S. PATENT DOCUMENTS

| | | | |
|---|---|---|---|
| 2,765,741 | 10/1956 | Hageman | 123/450 |
| 2,775,233 | 12/1956 | Bischoff et al. | 123/450 |
| 2,790,432 | 4/1957 | Shallenberg et al. | 123/450 |
| 4,376,432 | 3/1983 | Davis | 123/450 |

FOREIGN PATENT DOCUMENTS 2037365 7/1980 United Kingdom .

OTHER PUBLICATIONS

B. Grunwald, (Bucharest 1980), "The Theory, Calculation and Contraction of Automotive" pp. 692 & 693.

*Primary Examiner*—Charles Freay
*Attorney, Agent, or Firm*—Herbert Dubno

[57] ABSTRACT

A rotary distributor fuel injection apparatus comprises a distributor rotor (3) having a fuel inlet port (c) and delivery port (d) which communicates in turn with successive ports (g) supplying individual cylinders. The rotor (3) has a central axial passage (b) connected to the ports (c) and (d) and a radially drilled port (e) which aligns succesively with ports (h), radially drilled in the sleeve (13), whose rotation is controlled by a helical groove (i) on a thrust sleeve (14) through a peg (17) located on the sleeve (14). Centrifugal governor weights (15) and (16) control the position of the sleeve (14) and thereby the instant at which the port (e) communicates with a port (h) to terminate injection.

1 Claim, 1 Drawing Sheet

ROTARY DISTRIBUTOR FUEL INJECTION APPARATUS

FIELD OF THE INVENTION

This invention relates to a rotary distributor fuel; injection apparatus for supplying fuel to internal; combustion engines.

BACKGROUND OF THE INVENTION

The distributor type of fuel injection pump is well known. It feeds the injectors by pushing a pair of pumping plungers mounted in a transversely extending bore formed in the rotary distributor. The pumping plungers are actuated by shoes which are carried by rollers operated by the internal peripheral surface of a cam ring. The variation of the amount of fuel delivered to the engine is obtained by modifying through a throttle the flow area to the inlet port in the hydraulic head (see "The Theory, Calculation and Construction of Automotive Engines", B. Grünwald Bucharest, 1980).

A disadvantage of this pump is that the metering valve leads to delivery variations between injectors at partial loads and to irregular running of the engine. Another drawback is the fixed end of the injection cycle which leads to higher specific fuel consumption.

There is also known another rotary distributor fuel injection pump in which fuel injection is also effected by opposed pump plungers operated by an internal cam ring. Control of fuel delivery is obtained by modifying the travel of the plungers through hydraulically controlled axial movement of the distributor rotor. Since this rotar has a complex design it can be of to low reliability (GB 2,037,365 A).

SUMMARY OF THE INVENTION

The rotary distributor fuel injection apparatus according to the invention eliminates these disadvantages because the distributor rotor has a radially drilled port. Via this port, fuel is sent into the pump housing. At the instant at which the injection cycle is to be end, the radial port comes into communication with a bore formed in a sleeve. Angular movement of the sleeve is caused by a helical groove in a thrust sleeve whose position controls the amount of fuel delivered according to the speed of the associated engine, by modifying the injection period.

The apparatus of the aforesaid kind meets the following performance requirements:

low specific fuel consumption at partial loading;

simple design; and decrease of noise and vibration level of the engine.

BRIEF DESCRIPTION OF THE DRAWING

The above and other objects, features, and advantages will become more readily apparent from the following description, reference being made to the sole Figure of which is a partial axial section of a distributor according to the invention.

SPECIFIC DESCRIPTION

Figure 1:
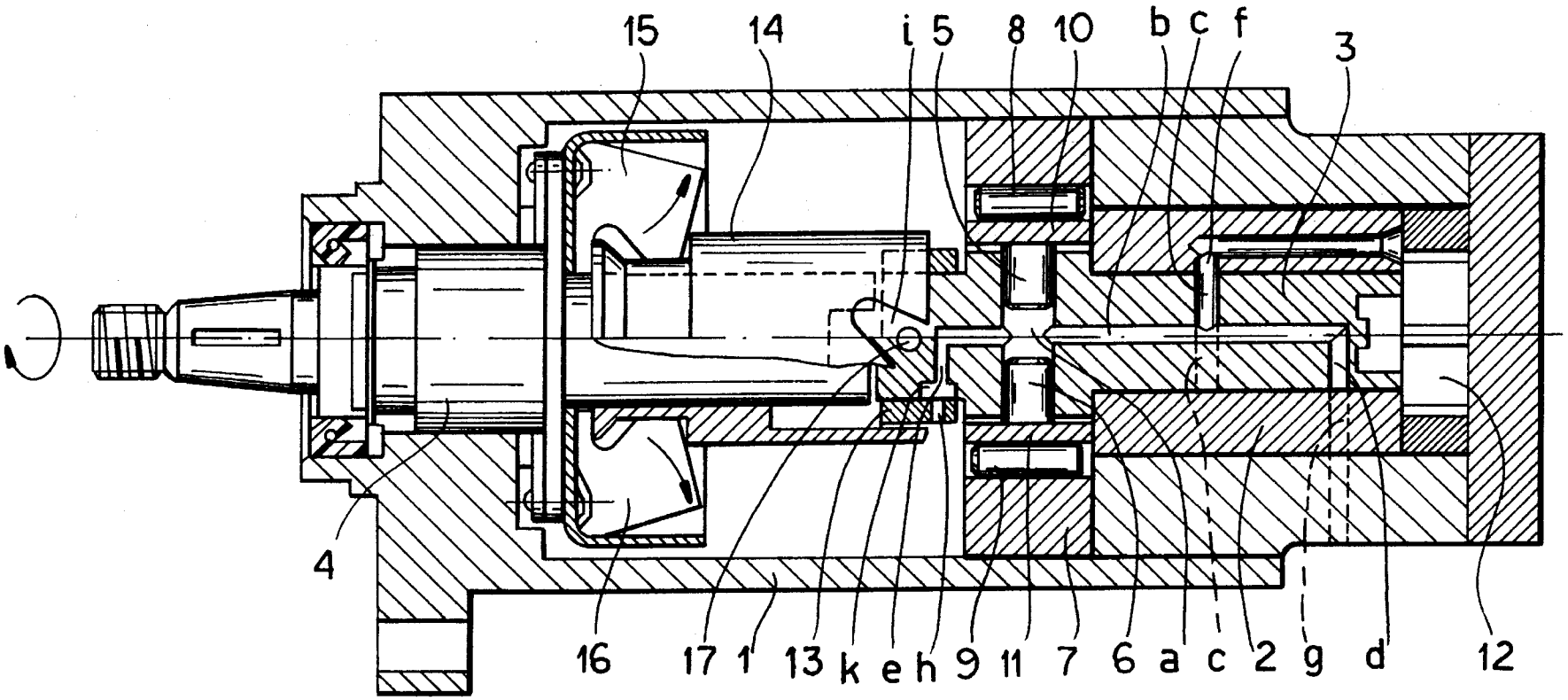
Figure 2:
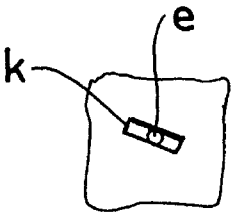

FIG. 1 shows a partial axial section of the rotary distributor fuel-injection apparatus according to the invention, and FIG. 2 is a detail view showing the oblique groove of the distributor member.

The apparatus shown in the drawing comprises a body part indicated at 1, in which is secured a hydraulic head 2, which forms a mated assembly with a distributor rotor 3, engaged with the drive shaft 4. In the distributor member are formed transverse bores a within which twin opposed plungers 5 and 6 are located, being actuated by rollers 8 and 9 which are carried by shoes 10 and 11 operated by the internal lobes of a stationary cam ring 7.

The distributor rotor 3 has a central axial passage b, with radially drilled inlet ports c for fuel, a radially drilled port d for fuel delivery and another radially drilled port e for controlling the injection period. As the distributor member 3 rotates, the radial ports c align successively with the port f, which is drilled radially in the hydraulic head 2, fuel being supplied by a transfer pump 12.

With further rotation of the distributor rotor 3, the delivery port d is put in communication successively with the outlet ports g, in the hydraulic head 2, whose number is equal to the number of cylinders of the engine, at the instant at which the pumping plungers 5 and 6 are forced inwards by the rollers 8 and 9 in contact with the internal lobes of the cam ring 7, thereby, pumping the fuel located in the pumping section a of the rotor.

Termination of the fuel delivery takes place when the radial port e and a groove k in the distributor rotor 3 are put in communication with ports h, radially drilled in the sleeve 13.

The rotation of the sleeve 13 is controlled by a helical groove i, milled on the thrust sleeve 14, axial movement of which is caused by centrifugal pivoting governor weights 15 and 16, through a peg 17 located on the sleeve 13 and engaged in the groove i. The inclination of the groove k to the pump axis may vary for example between 0° and 45°.

At the instant at which the groove k communicates with a radial port h, fuel is released into the pump housing, the injection pressure diminishes and the injection cycle is stopped.

We claim:

1. A rotary distributor fuel-injection apparatus, comprising:

a distributor body;

a hydraulic head mounted in said distributor body having at least one fuel inlet bore and at least one fuel outlet bore;

a distributor member axially fixed in and rotatable relative to said head, said distributor member having an axial bore, radial bores connected to said axial bore and alignable with said fuel inlet bore and said fuel outlet bores, a further radial bore communicating with said axial bore, an oblique groove along a periphery of said distributor member communicating with said further radial bore, a transverse bore communicating with said axial bore, and a pair of opposite pumping plungers displaceable in said transverse bore;

a cam in said body surrounding said distributor member and controlling said pumping plungers upon rotation of said distributor member;

a shaft rotatable in said body and connected with said distributor member for rotating same;

governor weights on said shaft;

a thrust sleeve on said shaft directly engaged by and axially displaceable by said governor weights, said thrust sleeve being formed directly with a helical groove; and a valve sleeve rotatable on said distributor member, formed with a radial port alignable with said oblique groove, and provided with a peg received in said helical groove for direct rotation of said valve sleeve by said thrust sleeve for discharge of fluid from said axial bore into said body to terminate an injection cycle.

* * * * *